United States Patent [19]

Itikawa

[11] Patent Number: 4,676,445

[45] Date of Patent: Jun. 30, 1987

[54] FILM HANDLING METHOD

[75] Inventor: Koji Itikawa, Kanagawa, Japan

[73] Assignee: Fuji Photo Film Co., Ltd., Kanagawa, Japan

[21] Appl. No.: 769,093

[22] Filed: Aug. 26, 1985

Related U.S. Application Data

[63] Continuation of Ser. No. 576,825, Feb. 3, 1984.

[30] Foreign Application Priority Data

Feb. 4, 1983 [JP] Japan ..... 58-16973

[51] Int. Cl.[4] ..... B65H 16/00; B65H 20/02; B65H 20/14; G03D 13/00

[52] U.S. Cl. ..... 242/55; 226/7; 226/91; 226/97; 354/319

[58] Field of Search ..... 242/195, 55, 57; 226/97, 91, 12, 7, 35, 176, 177; 206/398, 400, 53, 54; 354/298, 312, 313, 319, 320, 321, 322; 156/502, 505, 506

[56] References Cited

U.S. PATENT DOCUMENTS

| | | | |
|---|---|---|---|
| 872,411 | 12/1907 | Greenawalt | 206/400 X |
| 3,127,120 | 3/1964 | Selsted et al. | 226/97 X |
| 3,134,527 | 5/1964 | Willis | 226/97 |
| 3,227,017 | 1/1966 | Bader | 226/97 X |
| 3,276,425 | 10/1966 | Rabb | 226/97 X |
| 3,613,977 | 10/1971 | Egan | 226/91 |
| 3,795,371 | 3/1974 | Tolini et al. | 226/91 X |
| 3,823,895 | 7/1974 | Jones et al. | 242/195 X |
| 3,998,325 | 12/1976 | Kulka | 206/400 |
| 3,999,696 | 12/1976 | Reba et al. | 226/91 X |
| 4,094,726 | 6/1978 | Hujer et al. | 354/313 X |
| 4,243,186 | 1/1981 | Peter et al. | 226/97 X |
| 4,296,857 | 10/1981 | Huck | 206/400 X |
| 4,555,076 | 11/1985 | Uchiyama | 226/91 X |
| 4,557,425 | 12/1985 | Ichikawa | 354/313 X |

*Primary Examiner*—Harvey C. Hornsby
*Assistant Examiner*—Scott J. Haugland
*Attorney, Agent, or Firm*—Sughrue, Mion, Zinn, Macpeak & Seas

[57] ABSTRACT

Handling of strip films is improved by providing a method of film handling capable of advancing films wound in either direction. The winding direction of the film is detected, and an air flow is generated and the film spool is unwound depending on this detection. After being preliminarily unwound, the film is positively engaged and fed by advancing rollers.

6 Claims, 2 Drawing Figures

FILM HANDLING METHOD

This is a continuation of application Ser. No. 576,825, filed Feb. 3, 1984.

BACKGROUND OF THE INVENTION

This invention relates to a film handling method and more particularly to a film handling method wherein film is taken up from a film cartridge, is held in a non-slackened condition, and is received, and wherein the film is held with its leading end at the head to splice it.

The above mentioned operation wherein the film is fed with its leading end at the head is termed "head exposure" by those skilled in the art. For this reason, stated otherwise, the invention also relates to a method for subjecting the film taken up from the film cartridge to "head exposure". Problems in the "head exposure" treatment arise in handling the film in the cartridge, when it is wound with an outwardly facing sensitive coating opposite to the direction of normal winding (in which the sensitive coating is turned inwardly). This is because this film is required to be treated similarly to film wound in the normal direction.

SUMMARY OF THE INVENTION

It is an object of the invention to provide a film handling method for teating films wound in a direction reverse to the direction of normal winding the same as films wound in the direction of normal winding.

The aforementioned object of the invention is accomplished by a film handling method including receiving a film taken up from a patrone together with tensioning (anti-slack) means, supplying an air flow to feed the leading end of the film, and rotating the film in the unwinding direction, based on information on the direction of film winding.

BRIEF DESCRIPTION OF THE DRAWINGS

An embodiment of the present invention will be described hereinafter with reference to the accompanying drawings, in which.

BRIEF DESCRIPTION OF THE PREFERRED EMBODIMENT

Figure 1:
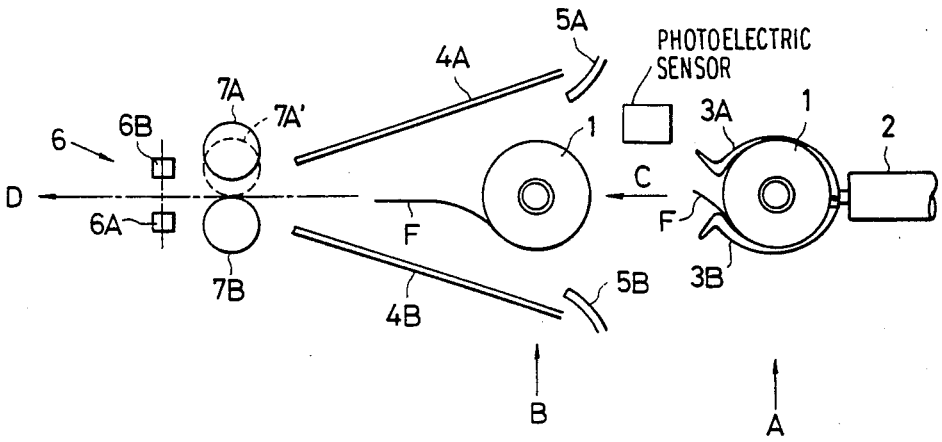
FIG. 1 is a side view of a main portion of a film handling apparatus, showing one embodiment of the invention.

FIG. 1 is a side view showing the main portion of a film handling apparatus in which the present invention is embodied, wherein numerals 1 and 2 respectively designate a spool onto which a film F is wound, and a rod for supporting tensioning claws 3A, 3B (hereinafter referred to as anti-slack claws), each of which are adapted to prevent the film from slackening when wound.

Numerals 4A, 4B and 5A, 5B respectively denote film guides and air flow supply nozzles for feeding the leading end of the film. More specifically, 5A is an air nozzle (hereinafter referred to as a reverse winding air nozzle) for film wound in a direction reverse to the normal winding direction. 5B is another air nozzle (hereinafter referred to as the forward winding air nozzle) for film wound in the normal winding direction. Numeral 6 indicates a detector 6A, 6B such as a photo-detector containing elements detecting the leading end of the fed film. A driven roller 7 is moved to a position shown at 7A' by means of a film detecting signal from the detector 6 and forms a pair of nip rollers along with a drive roller 7B. Character A designates a film which is taken up from a film cartridge by a film takeup means provided in a stage previous to the instant apparatus, and which prevents the film from slackening in winding. Character B indicates the position where the film is received and subjected to the "head exposure treatment". Arrows C and D denote the direction of movement of the film in transit, and the direction of film delivery, respectively.

Figure 2:
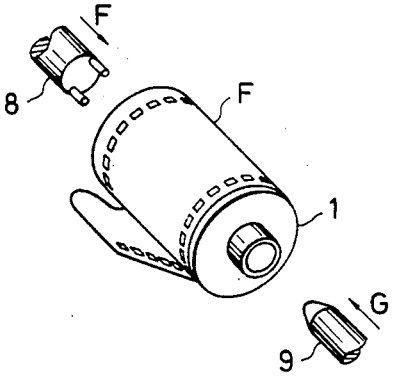
FIG. 2 is a perspective view of a film receiving mechanism.

FIG. 2 is a perspective view showing the manner in which the spool 1, on which is wound the film F from the cartridge, is accepted in the position B. Numerals 8 and 9 denote a rotary shaft coupled to a drive source (not shown), and a clamp pin, respectively.

The rotary shaft 8 and the clamp pin 9 are moved in the directions E, G to hold the spool 1.

The operation of the above described apparatus will be explained hereinafter.

When the film F taken up from the patrone is held by the anti-slack claws 3A, 3B and is supplied by the rod 2 to the position B, the spool 1 is held by the rotary shaft 8 and the clamp pin 9. During this time, photoelectric sensing means determines whether the film F is forwardly or reversely wound. According to the result of this detection, an air flow is supplied from either the reverse winding air nozzle 5A or the forward winding air nozzle 5B with the film F held by the anti-slack claws 3A, 3B. Upon the initiation of the supply of the air flow, the anti-slack claws 3A, 3B are moved backwardly along with the claw supporting rod 2, to the right in FIG. 1, to release the film F from engagement therewith.

At about the same time, the rotary shaft 8, according to the winding direction determination, initiates its rotation in a direction so as to unwind the film F, to guide the leading end of the film F along the film guides 4A, 4B under the influence of shaft rotation and the air flow. More specifically, the spool 1 as shown in FIG. 1 is rotated clockwise and an air flow is supplied from the air nozzle 5A, whereas negative pressure is provided by the air flow on the side of the air nozzle 5B. By this action, the film F is caused to positively expose its leading end. When the leading end of the film F passes through an outlet defined by the film guides 4A, 4B and the pair of rollers 7A, 7B and reaches the detector 6, the roller 7A is moved to the position 7A' shown in the broken line by a film detecting signal sent from the detector 6. At the same time, the roller 7B is driven to feed the film F in the direction of arrow D. When the film F wound on the spool 1 terminates its running, a sensing means (not shown) senses the same to actuate a cutter which cuts the tail end of the film. Thereafter, the rotary shaft 8 and the clamp pin 9 throw out the empty spool 1 and receive the next film, and then repeat the same behavior. The determination of the direction of film winding may be made in any processing stage, such as during taking up the film from the film cartridge, feeding the film for the aforementioned behavior, or setting the film in the position B. The timing of the retraction of the anti-slack claws, the initiation of the supply of air from the air nozzle or the driving of the rotary shaft and so on may be suitably altered as necessity requires.

The positions A and B are not required to be in alignment with one another as shown in FIG. 1 but may be out of alignment. This is because the speed required for the overall treatment of the film is improved by feeding the next film to the reception or takeup position during the "head exposure" of the previous film.

In a case where the film is not detected by the detector 6 after a predetermined period of time has lapsed from when the "head exposure" treatment started, it may be practicable to repeat such treatment after reversely rotating the rotary shaft 8. Additionally, of course, an alarm is given the operator in such a case.

As set forth hereinabove, according to the present invention, film taken up from the film cartridge is received and fed via anti-slack means while an air flow for feeding the film leading end is supplied simultaneously with the rotation of the film in a direction unwinding the same, based on information on the direction of film winding. Advantages are derived from this method in that the film may be smoothly fed irrespective of the forward or reverse winding of the film.

I claim:

1. A method of film handling, comprising: receiving said film in a wound condition together with anti-slack means; photoelectrically sensing said film to determine the winding direction thereof; supplying an air flow from a selected one of at least two air flow sources, for preliminarily feeding a leading end of said film, retracting said anti-slack means subsequent to the initiation of said air flow, subsequently continuing said air flow while simultaneously rotating a film support to advance said film, the selected one of said air flow sources and the direction of said rotation being dependent upon said determination of said winding direction; and subsequently positively engaging and transporting said film.

2. A film handling method set forth in claim 1, further including retracting said anti-slack means while supplying said air flow.

3. A film handling method set forth in claim 1, further comprising supplying said air flow in a direction generally opposing said winding direction.

4. A film handling method set forth in claim 3, wherein said step of positively engaging and transporting said film comprises detecting a leading end of said film, and engaging said film with a pair of driven nip rollers in response to said detection.

5. A film handling method set forth in claim 1, wherein said film is received on a spool, and said step of advancing said film comprises rotating said spool in a direction so as to unwind said film therefrom.

6. A film handling apparatus for feeding a film, comprising:

means for transporting the film in a wound condition to an unwinding location, support means for rotatably supporting said film in a wound condition on a spool at said unwinding location, means for detecting the winding direction of said wound film, and a pair of air supply means responsive to said detecting means for preliminarily feeding a leading end of said film and for advancing said film so as to unwind said film from said spool, said pair of air supply means being positioned on opposite sides of said spool, one and only one of said air supplying means being operated to unwind said film, with said one being selected in accordance with the film winding direction.

* * * * *